US008058807B2

(12) United States Patent
Chao

(10) Patent No.: US 8,058,807 B2
(45) Date of Patent: Nov. 15, 2011

(54) FLOURESCENT LAMP WHOSE BALLAST HAS AN OUTPUT POWER THAT IS REGULATED FOR FLOURESCENT TUBES OF DIFFERENT POWER SPECIFICATIONS

(75) Inventor: Wen-Hsin Chao, Changhua Hsien (TW)

(73) Assignee: Kaoyi Electronic Co., Ltd., Changhua Hsien (TW)

( * ) Notice: Subject to any disclaimer, the term of this patent is extended or adjusted under 35 U.S.C. 154(b) by 550 days.

(21) Appl. No.: 12/346,321

(22) Filed: Dec. 30, 2008

(65) Prior Publication Data

US 2010/0164395 A1 Jul. 1, 2010

(51) Int. Cl.
*H05B 37/00* (2006.01)

(52) U.S. Cl. ..... 315/71; 315/56; 313/318.09

(58) Field of Classification Search ..... 315/56, 315/51, 52, 54, 53, 71; 313/317, 318.01, 313/318.02, 318.03, 318.05, 318.06
See application file for complete search history.

(56) References Cited

U.S. PATENT DOCUMENTS

| | | | | |
|---|---|---|---|---|
| 4,337,414 | A * | 6/1982 | Young | 315/56 |
| 7,256,547 | B2 * | 8/2007 | Kubota et al. | 315/56 |
| 7,293,897 | B2 * | 11/2007 | Mendelsohn | 362/260 |
| 7,592,742 | B2 * | 9/2009 | Takahara et al. | 313/490 |

* cited by examiner

*Primary Examiner* — David Hung Vu
(74) *Attorney, Agent, or Firm* — Alan Kamrath; Kamrath & Associates PA

(57) ABSTRACT

A fluorescent lamp includes a ballast, a holder, a power regulating switch, and a fluorescent tube. The power regulating switch includes a housing, a base, plurality of inductors, a plurality of first contacts, a plurality of second contacts, a plurality of conducting bridges, a plurality of push rods, and a plurality of elastic members. The circuit of the power regulating switch has different values of inductance and output power by provision of the inductors, and the output power of the power regulating switch is regulated by the electrical connection between each of the first contacts and the respective different second contact so as to fit the fluorescent tube of different power specifications.

20 Claims, 10 Drawing Sheets

FLOURESCENT LAMP WHOSE BALLAST HAS AN OUTPUT POWER THAT IS REGULATED FOR FLOURESCENT TUBES OF DIFFERENT POWER SPECIFICATIONS

BACKGROUND OF THE INVENTION

1. Field of the Invention

The present invention relates to a lamp and, more particularly, to a fluorescent lamp.

2. Description of the Related Art

A conventional fluorescent lamp comprises a ballast, a holder mounted on the ballast, and a fluorescent tube detachably mounted on the holder and electrically connected with the ballast. The ballast provides a determined starting voltage and a stabilized current to the fluorescent tube so that the fluorescent tube is lighted successively and stably. The ballast has a determined output power. However, the fluorescent tube has different power specifications (such as 13, 18 and 26 watt), so that the ballast cannot fit the fluorescent tubes having different power specifications, thereby limiting the versatility of the ballast and the fluorescent lamp.

BRIEF SUMMARY OF THE INVENTION

In accordance with the present invention, there is provided a fluorescent lamp, comprising a ballast, a holder mounted on the ballast, a power regulating switch mounted in the holder and connected with the ballast, and a fluorescent tube detachably mounted on the holder and contacting the control switch to actuate the control switch to regulate an output power of the ballast. The power regulating switch includes a housing secured in the holder, a base received in the holder and combined with the housing, plurality of inductors mounted in the base, a plurality of first contacts each mounted in the base, a plurality of second contacts each mounted in the base and each electrically connected with at least one of the inductors, a plurality of conducting bridges each movable to touch and conduct a respective one of the first contacts and a respective one of the second contacts to form a circuit, a plurality of push rods each movably mounted on the housing and each abutting a respective one of the conducting bridges to move the respective conducting bridge to conduct the respective first contact and the respective second contact, and a plurality of elastic members each biased on a respective one of the conducting bridges to push the respective conducting bridge to detach from the respective first contact and the respective second contact.

The primary objective of the present invention is to provide a fluorescent lamp whose ballast has an output power that is regulated for fluorescent tubes of different power specifications.

Another objective of the present invention is to provide a fluorescent lamp, wherein the circuit of the power regulating switch has different values of inductance and different values of output power by provision of the inductors, and the output power of the power regulating switch is adjusted and regulated by the location of the identification block of the fluorescent tube and by the electrical connection between each of the first contacts and the respective different second contact of the power regulating switch so as to fit the fluorescent tube of different power specifications, thereby enhancing the versatility of the ballast.

A further objective of the present invention is to provide a fluorescent lamp, wherein the power regulating switch has a simple mechanical design, thereby decreasing the costs of fabrication of the fluorescent lamp.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
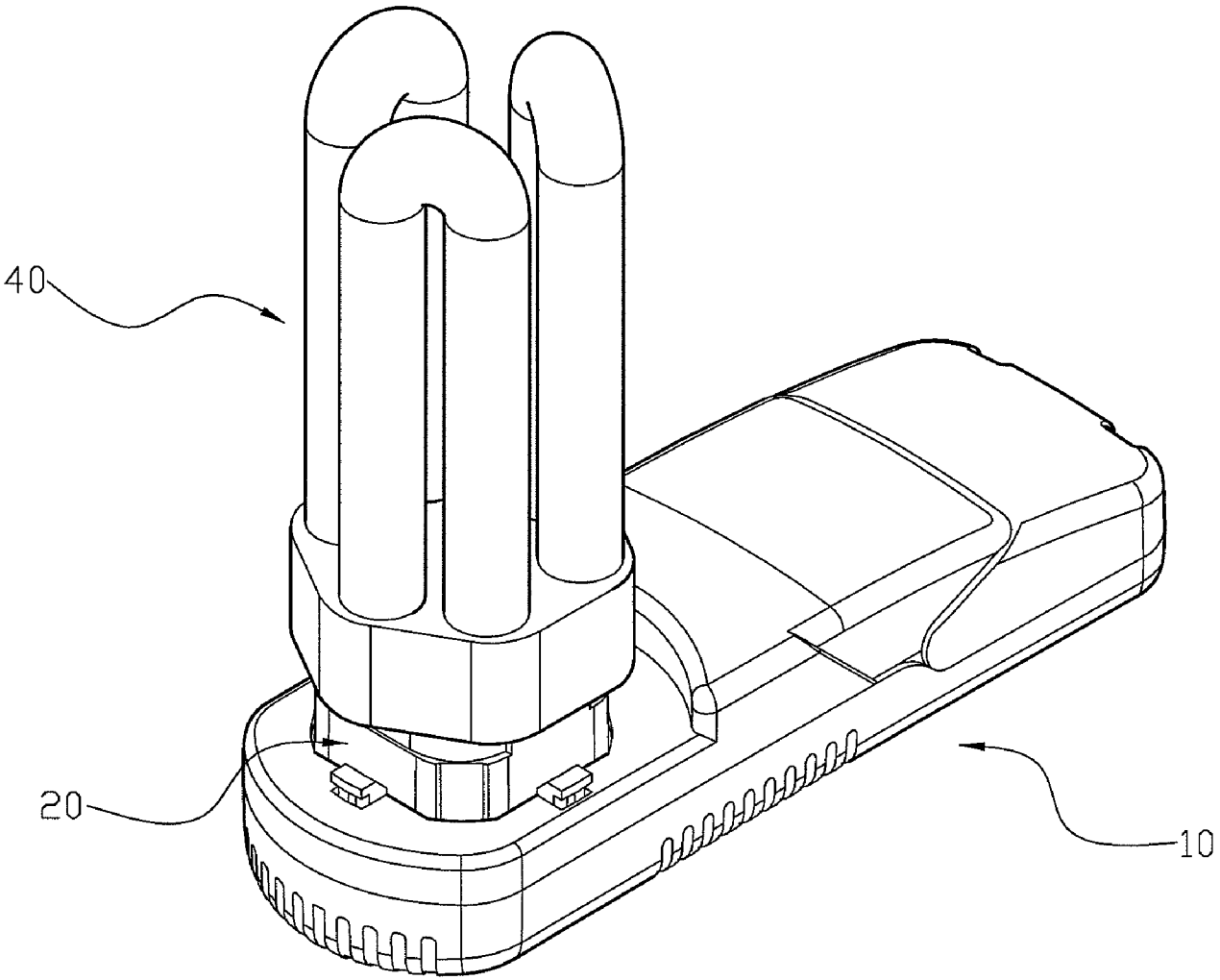
FIG. 1 is a perspective view of a fluorescent lamp in accordance with the preferred embodiment of the present invention.
Figure 2:
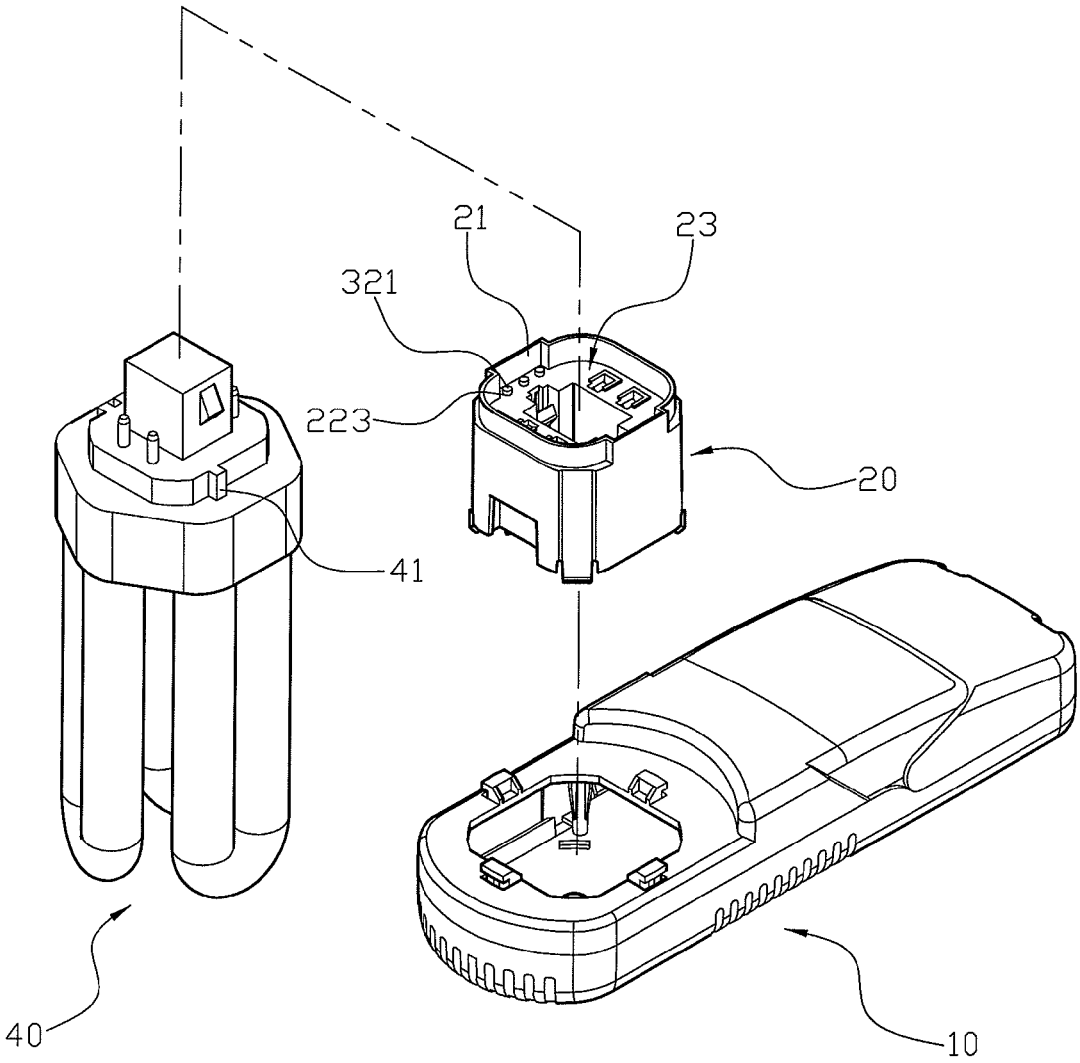
FIG. 2 is a partially exploded perspective view of the fluorescent lamp as shown in FIG. 1.
Figure 3:
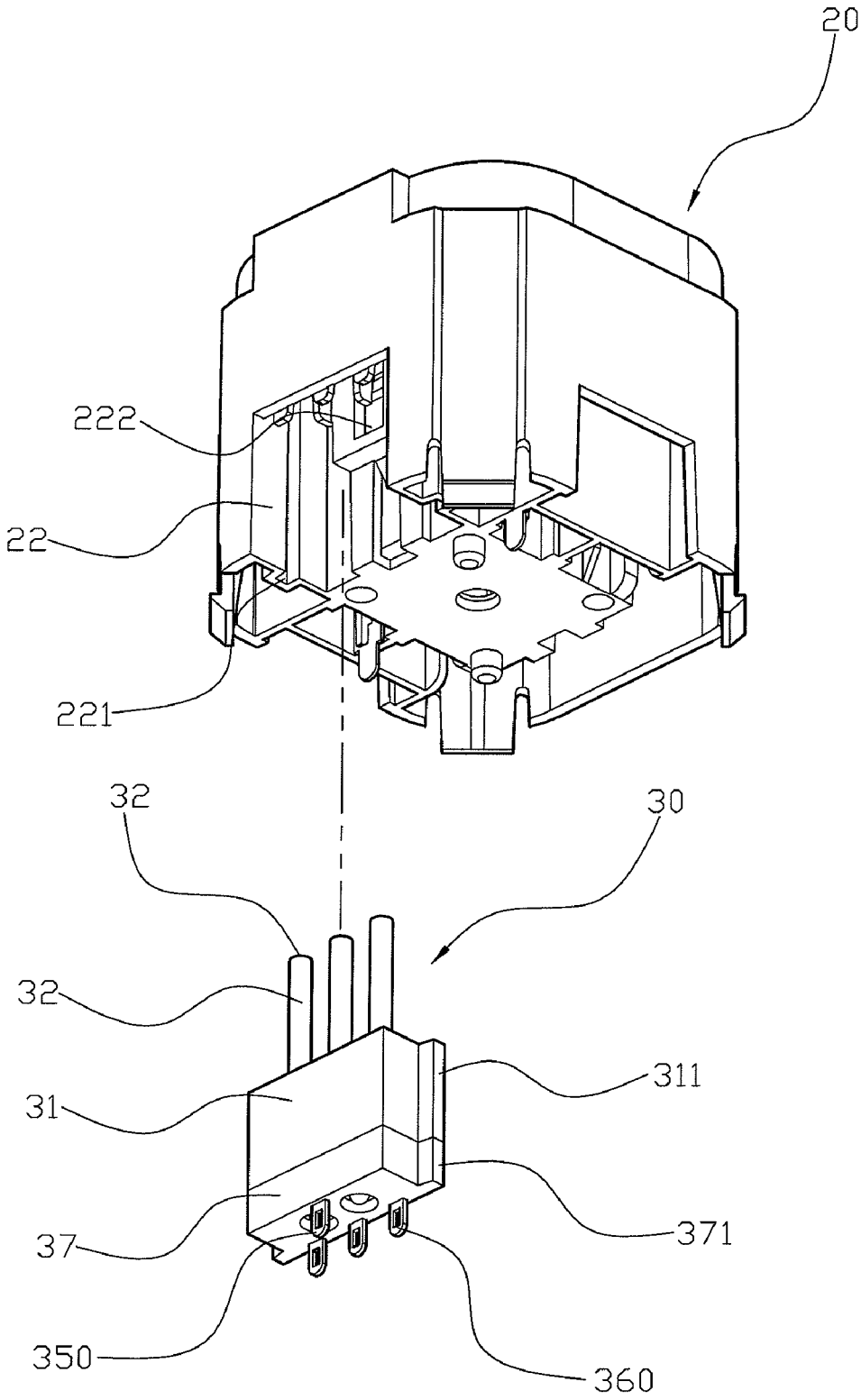
FIG. 3 is a partially exploded perspective view of the fluorescent lamp as shown in FIG. 1.
Figure 4:
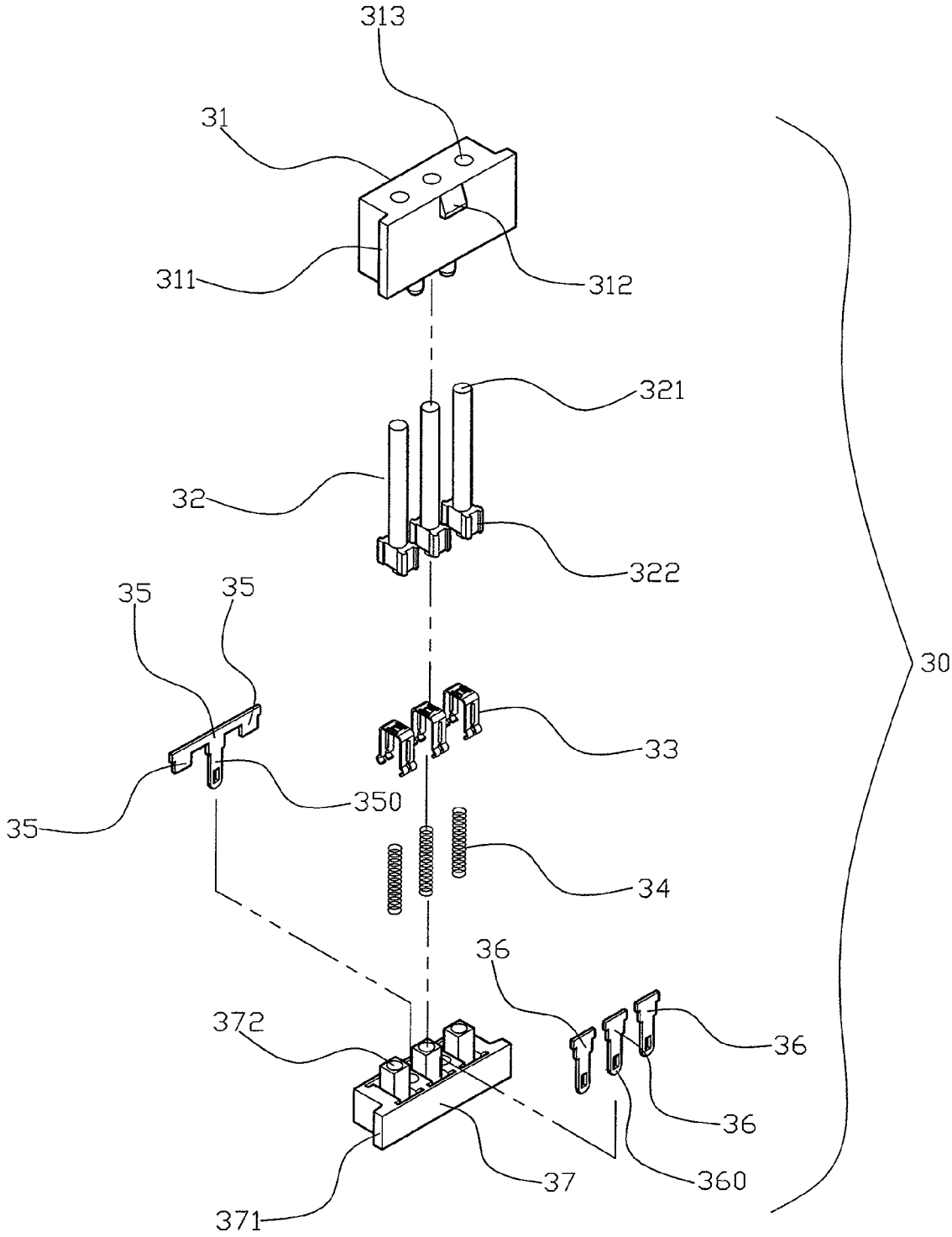
FIG. 4 is a partially exploded perspective view of the fluorescent lamp as shown in FIG. 1.
Figure 5:
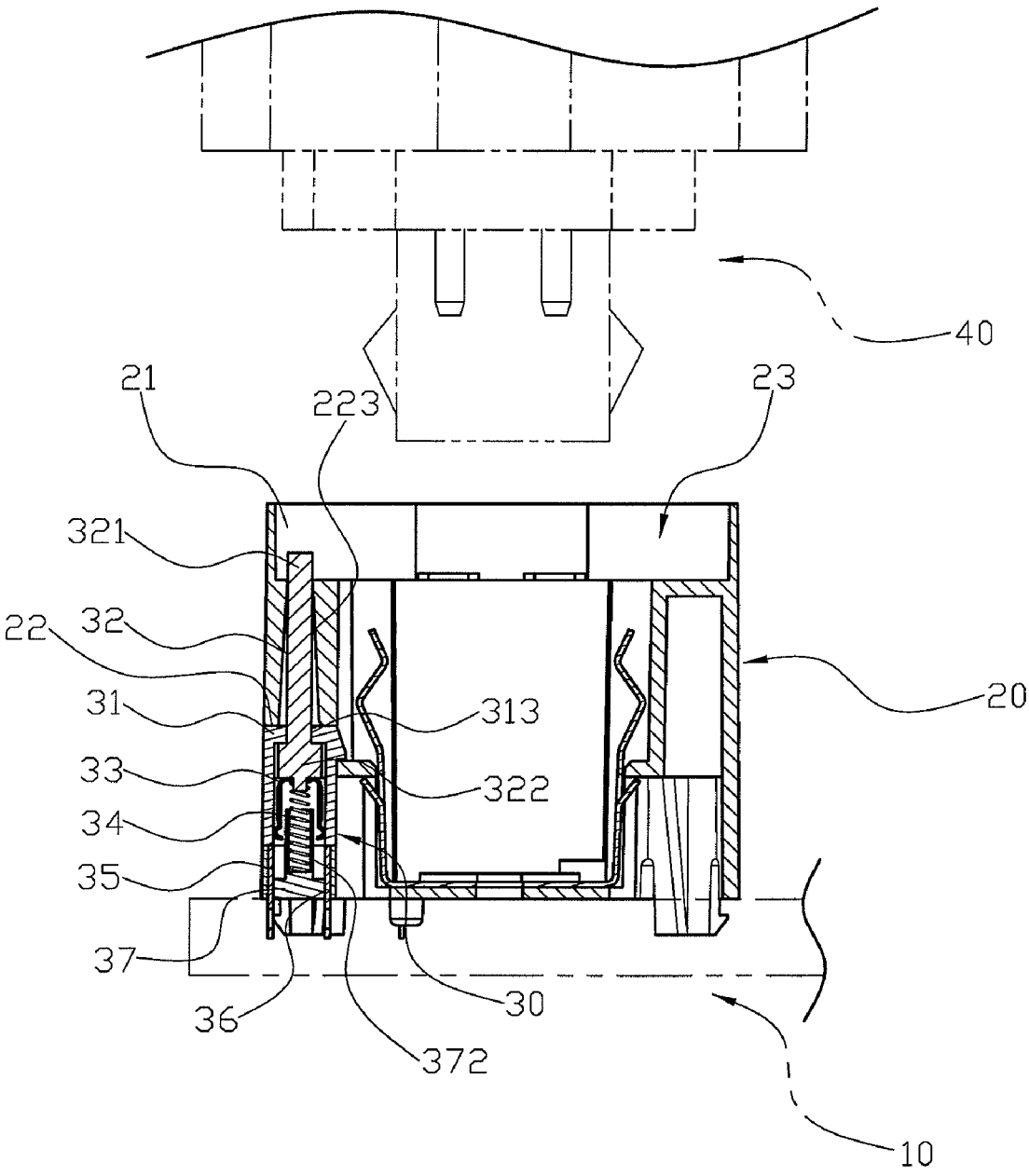
FIG. 5 is a front cross-sectional view of the fluorescent lamp as shown in FIG. 2.

Referring to the drawings and initially to FIGS. 1-6, a fluorescent lamp in accordance with the preferred embodiment of the present invention comprises a ballast 10, a holder 20 mounted on the ballast 10, a power regulating switch 30 mounted in the holder 20 and connected with the ballast 10, and a fluorescent tube 40 detachably mounted on the holder 20 and contacting the control switch 30 to actuate the control switch 30 to regulate an output power of the ballast 10.

The holder 20 has a first end provided with a slot 23 to allow insertion of the fluorescent tube 40, a second end provided with a chamber 22 to receive the control switch 30 and a mediate portion provided with a plurality of channels 223 connected between the slot 23 and the chamber 22. The slot 23 of the holder 20 has a periphery provided with two opposite enlarged passages 21. The chamber 22 of the holder 20 has a periphery provided with two opposite guide tracks 221 and has a side provided with a locking hole 222.

The power regulating switch 30 includes a housing 31 secured in the holder 20, a base 37 received in the holder 20 and combined with the housing 31, a plurality of inductors 38 (see FIG. 6) mounted in the base 37, a plurality of first contacts 35 each mounted in the base 37, a plurality of second contacts 36 each mounted in the base 37 and each electrically connected with at least one of the inductors 38, a plurality of conducting bridges 33 each movable to touch and conduct a respective one of the first contacts 35 and a respective one of the second contacts 36 to form a circuit, a plurality of push rods 32 each movably mounted on the housing 31 and each abutting a respective one of the conducting bridges 33 to move the respective conducting bridge 33 to conduct the respective first contact 35 and the respective second contact 36, and a plurality of elastic members 34 each biased on a respective one of the conducting bridges 33 to push the respective conducting bridge 33 to detach from the respective first contact 35 and the respective second contact 36.

The housing 31 of the power regulating switch 30 is received in the chamber 22 of the holder 20. The housing 31 of the power regulating switch 30 has a periphery provided with two opposite protruding guide rails 311 mounted in the two opposite guide tracks 221 of the holder 20 respectively to guide insertion of the housing 31 into the chamber 22 of the holder 20. The housing 31 of the power regulating switch 30 has a side provided with a locking block 312 snapped into and locked in the locking hole 222 of the holder 20 to fix the housing 31 of the power regulating switch 30 in the chamber 22 of the holder 20. The housing 31 of the power regulating switch 30 has a top provided with a plurality of conduits 313.

The base 37 of the power regulating switch 30 is received in the chamber 22 of the holder 20 and is located under the housing 31. The base 37 of the power regulating switch 30 has a periphery provided with two opposite protruding guide rails 371 mounted in the two opposite guide tracks 221 of the holder 20 respectively to guide insertion of the base 37 into the chamber 22 of the holder 20. The base 37 of the power regulating switch 30 has a periphery provided with a plurality of hollow posts 372 to receive the elastic members 34 respectively.

Each of the conducting bridges 33 of the power regulating switch 30 is a conductor. Each of the conducting bridges 33 of the power regulating switch 30 has a substantially inverted U-shaped profile and is movably mounted between the base 37 and the housing 31. Each of the conducting bridges 33 of the power regulating switch 30 is located above the base 37 and is located between the respective push rod 32 and the respective elastic member 34.

Each of the elastic members 34 of the power regulating switch 30 is biased between the base 37 and the respective conducting bridge 33. Each of the elastic members 34 of the power regulating switch 30 is received in a respective one of the hollow posts 372 of the base 37.

The first contacts 35 of the power regulating switch 30 are electrically connected with each other. The first contacts 35 of the power regulating switch 30 extend through the base 37. The first contacts 35 of the power regulating switch 30 are combined together to have a common lower leg 350 protruding outwardly from the bottom of the base 37 to connect an electric power supply.

The second contacts 36 of the power regulating switch 30 are separated from each other. Each of the second contacts 36 of the power regulating switch 30 extends through the base 37 and has a lower leg 360 protruding outwardly from the bottom of the base 37 to connect the electric power supply. Each of the second contacts 36 of the power regulating switch 30 is electrically connected with the inductors 38 of different numbers so that when each of the first contacts 35 and the respective second contact 36 of the power regulating switch 30 are conducted, the circuit of the power regulating switch 30 has different values of inductance. The inductors 38 of the power regulating switch 30 are connected serially.

Each of the push rods 32 of the power regulating switch 30 is movably mounted in a respective one of the channels 223 of the holder 20 and a respective one of the conduits 313 of the housing 31. Each of the push rods 32 of the power regulating switch 30 has an upper end 321 protruding outwardly from the respective channel 223 of the holder 20 into the slot 23 of the holder 20 and a lower end provided with an enlarged pressing block 322 abutting the respective conducting bridge 33. The upper end 321 of each of the push rods 32 extends into one of the two passages 21 of the holder 20. The pressing block 322 of each of the push rods 32 is movable in the housing 31 and is movable to abut the top of the housing 31 to prevent each of the push rods 32 being detached from the housing 31.

The fluorescent tube 40 has different power specifications. The fluorescent tube 40 has an end portion inserted into the slot 23 of the holder 20 and provided with a protruding identification block 41 pressing the upper end 321 of a respective one of the push rods 32 to push the respective push rod 32 and the respective conducting bridge 33 to conduct the respective first contact 35 and the respective second contact 36. The identification block 41 of the fluorescent tube 40 is inserted into one of the two passages 21 of the holder 20.

Figure 6:
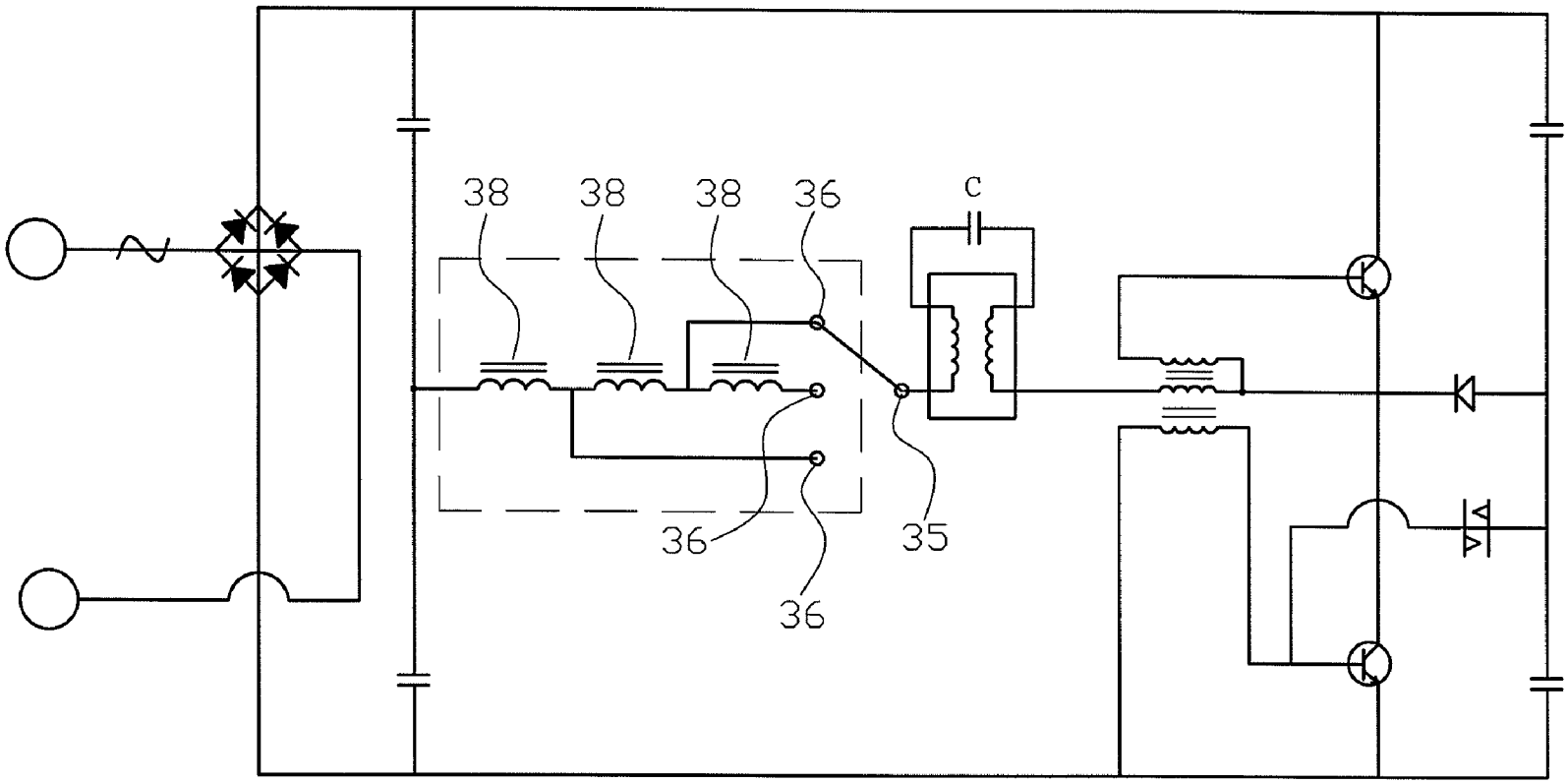
FIG. 6 is a circuit layout of the fluorescent lamp as shown in FIG. 1.
Figure 7:
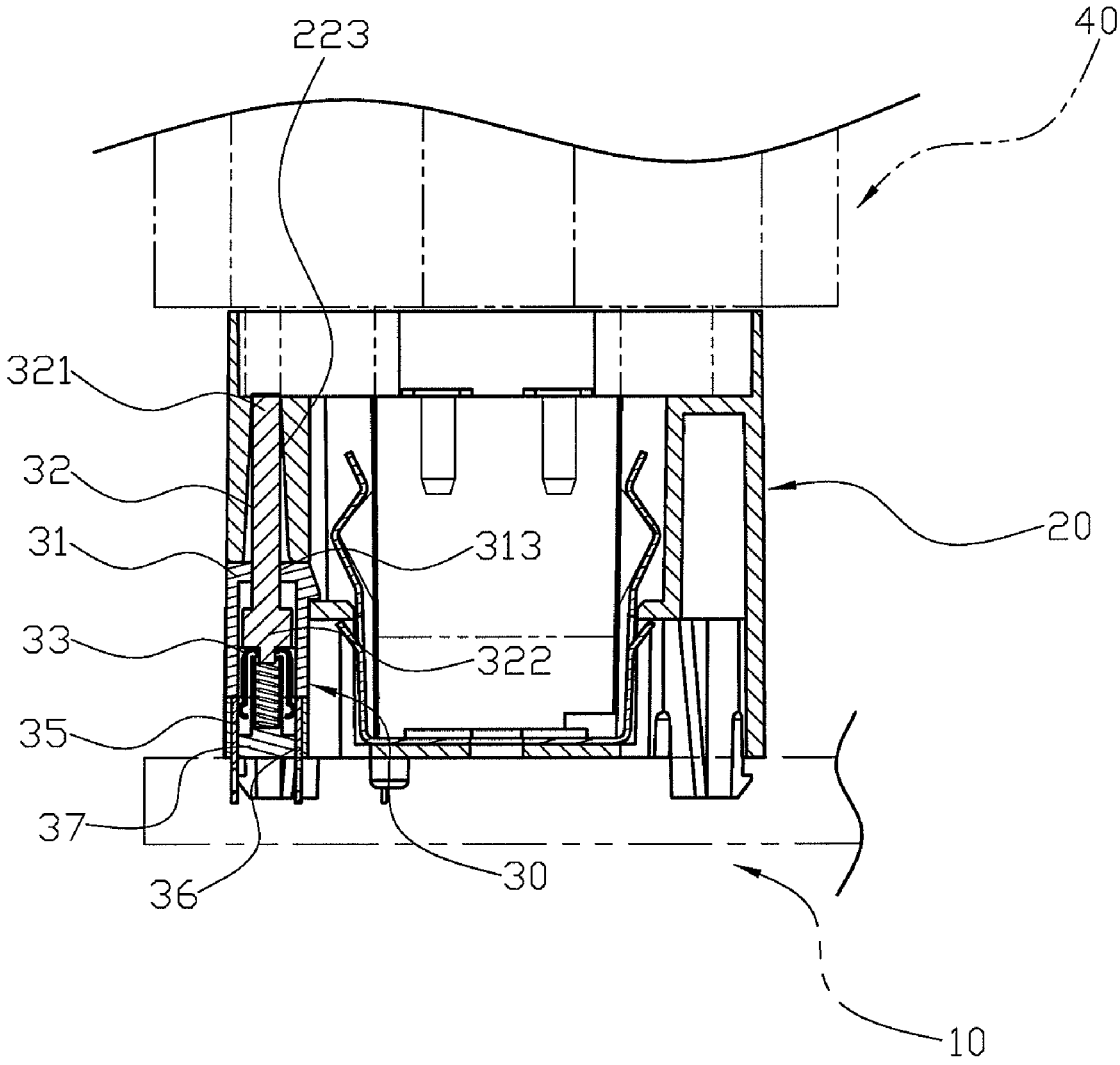
FIG. 7 is a front cross-sectional assembly view of the fluorescent lamp as shown in FIG. 5.
Figure 8:
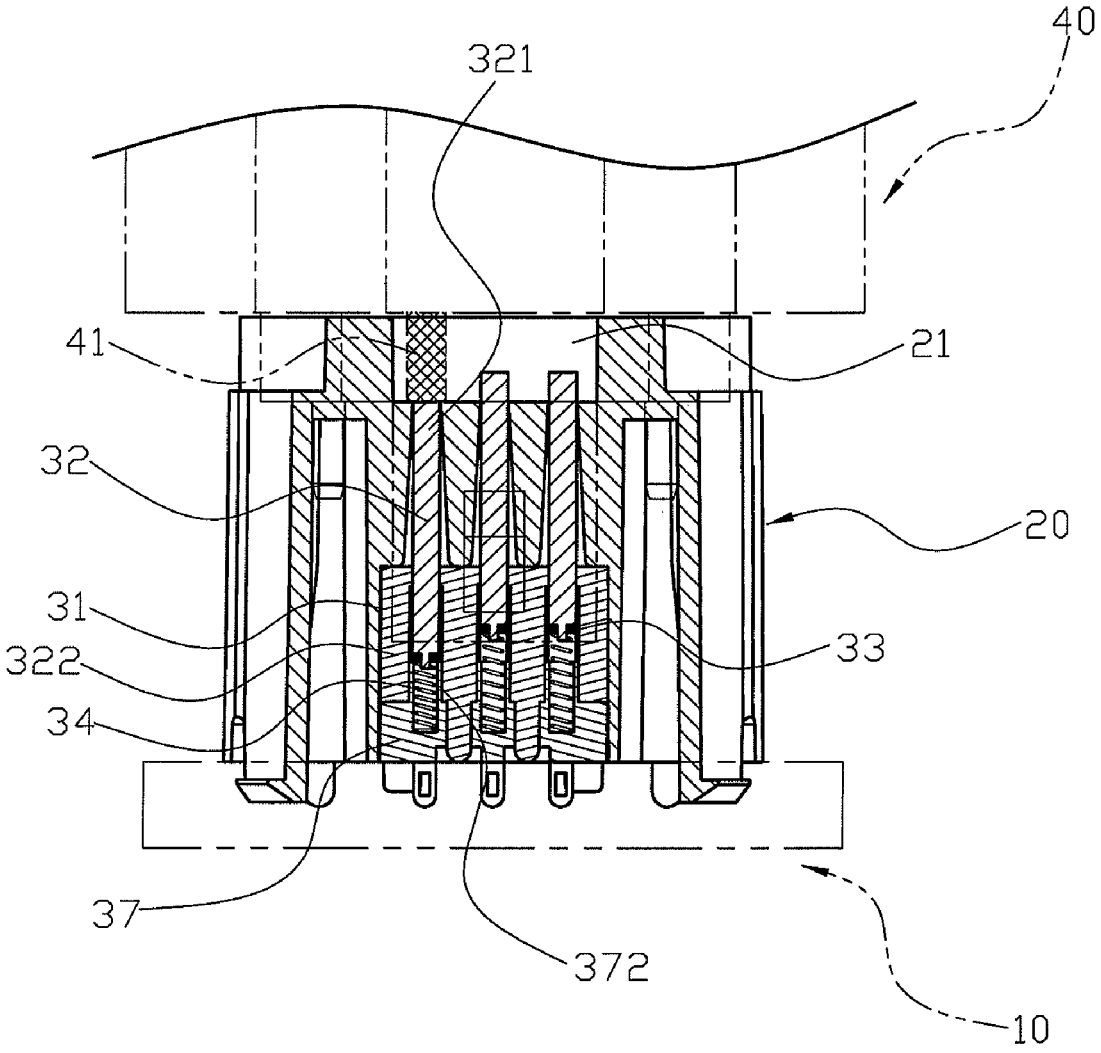
FIG. 8 is a side cross-sectional assembly view of the fluorescent lamp as shown in FIG. 2.

In practice, the power regulating switch 30 includes three inductors 38, three first contacts 35 and three second contacts 36, wherein a first one of the second contacts 36 is connected with one inductor 38, a second one of the second contacts 36 is connected with two inductors 38, and a third one of the second contacts 36 is connected with three inductors 38 as shown in FIG. 6, so that when each of the first contacts 35 and the respective second contact 36 of the power regulating switch 30 are conducted, the circuit of the power regulating switch 30 has different values of inductance and different values of output power.

According to the formula of $X_L=2\pi*f*L$ ($X_L$ is the inductive reactance, f is the frequency, and L is the inductance), when the frequency f is kept at a constant value, the inductive reactance $X_L$ is proportional to the inductance L. On the other hand, according to the formula of $P=V^2/R$ (P is the output power, V is the voltage, and R is the resistance), when the voltage V is kept at a constant value, the output power P is inversely proportional to the resistance R. Thus, the inductive reactance $X_L$ is proportional to the inductance L, and the output power P is inversely proportional to the resistance R. At this time, the action of the inductive reactance $X_L$ is similar to that of the resistance R. In such a manner, the output power P is inversely proportional to the inductive reactance $X_L$, so that the output power P is inversely proportional to the inductance L. Thus, when the inductance L passing through the circuit of the power regulating switch 30 is increased, the output power P of the power regulating switch 30 is decreased, and when the inductance L passing through the circuit of the power regulating switch 30 is decreased, the output power P of the power regulating switch 30 is increased.

In conclusion, when each of the first contacts 35 and the respective second contact 36 of the power regulating switch 30 are conducted, the circuit of the power regulating switch 30 has different values of inductance and different values of output power by provision of the inductors 38. In addition, the output power of the power regulating switch 30 is adjusted and regulated by freely changing the electrical connection between each of the first contacts 35 and the respective different second contact 36 of the power regulating switch 30 so as to fit the fluorescent tube 40 of different power specifications.

In operation, referring to FIGS. 5-8 with reference to FIGS. 1-4, when the end portion of the fluorescent tube 40 is inserted into the slot 23 of the holder 20, the identification block 41 of the fluorescent tube 40 is moved to press the upper end 321 of a respective one of the push rods 32 to push the respective push rod 32 and the respective conducting bridge 33 to conduct the respective first contact 35 with the respective second contact 36 and the respective inductors 38 so as to form the circuit of the power regulating switch 30.

In such a manner, the circuit of the power regulating switch 30 has different values of inductance and different values of output power by provision of the inductors 38, and the output power of the power regulating switch 30 is adjusted and regulated by the location of the identification block 41 of the fluorescent tube 40 and by the electrical connection between each of the first contacts 35 and the respective different second contact 36 of the power regulating switch 30 so as to fit the fluorescent tube 40 of different power specifications.

Figure 9:
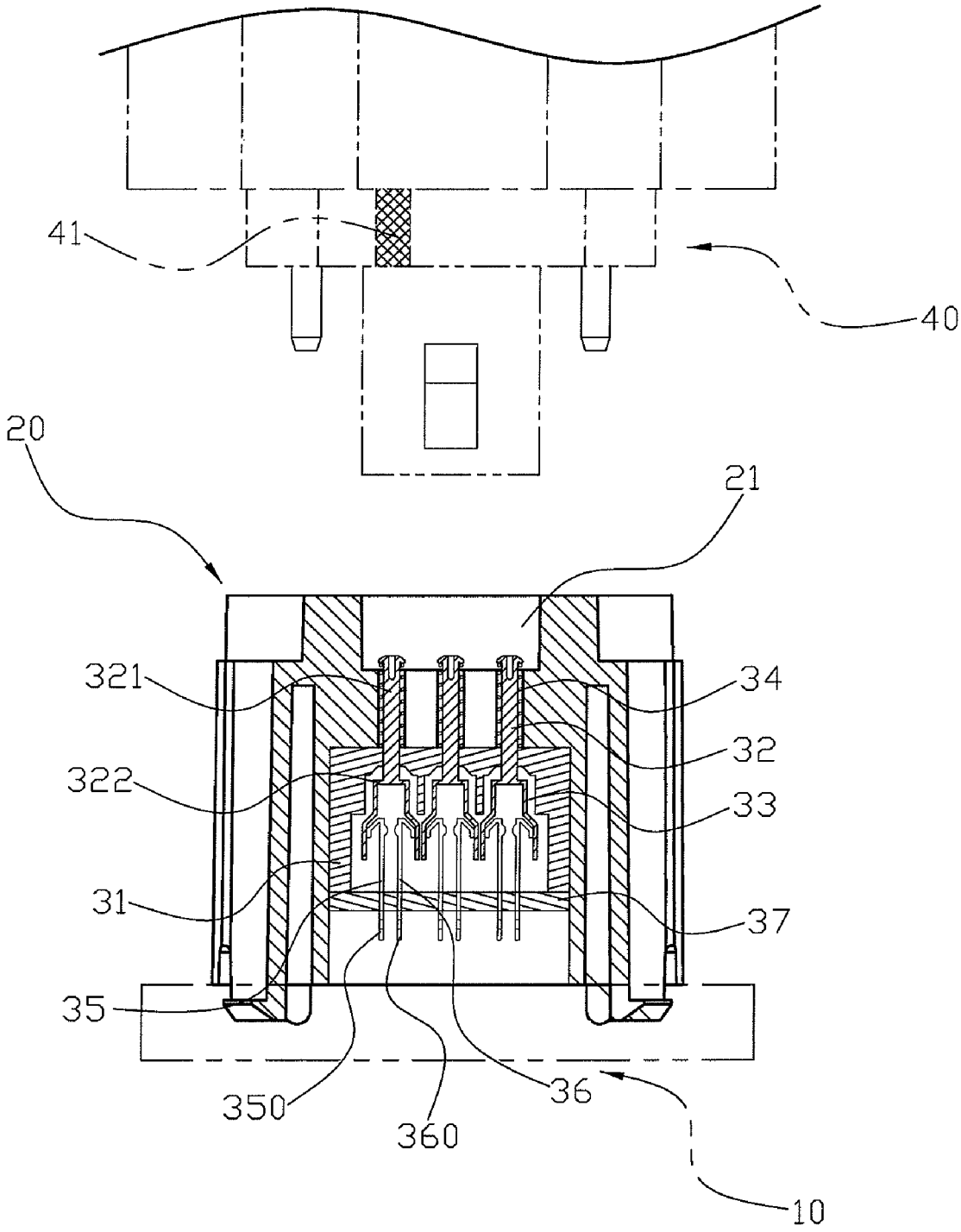
FIG. 9 is a partially exploded front cross-sectional view of a fluorescent lamp in accordance with another preferred embodiment of the present invention.
Figure 10:
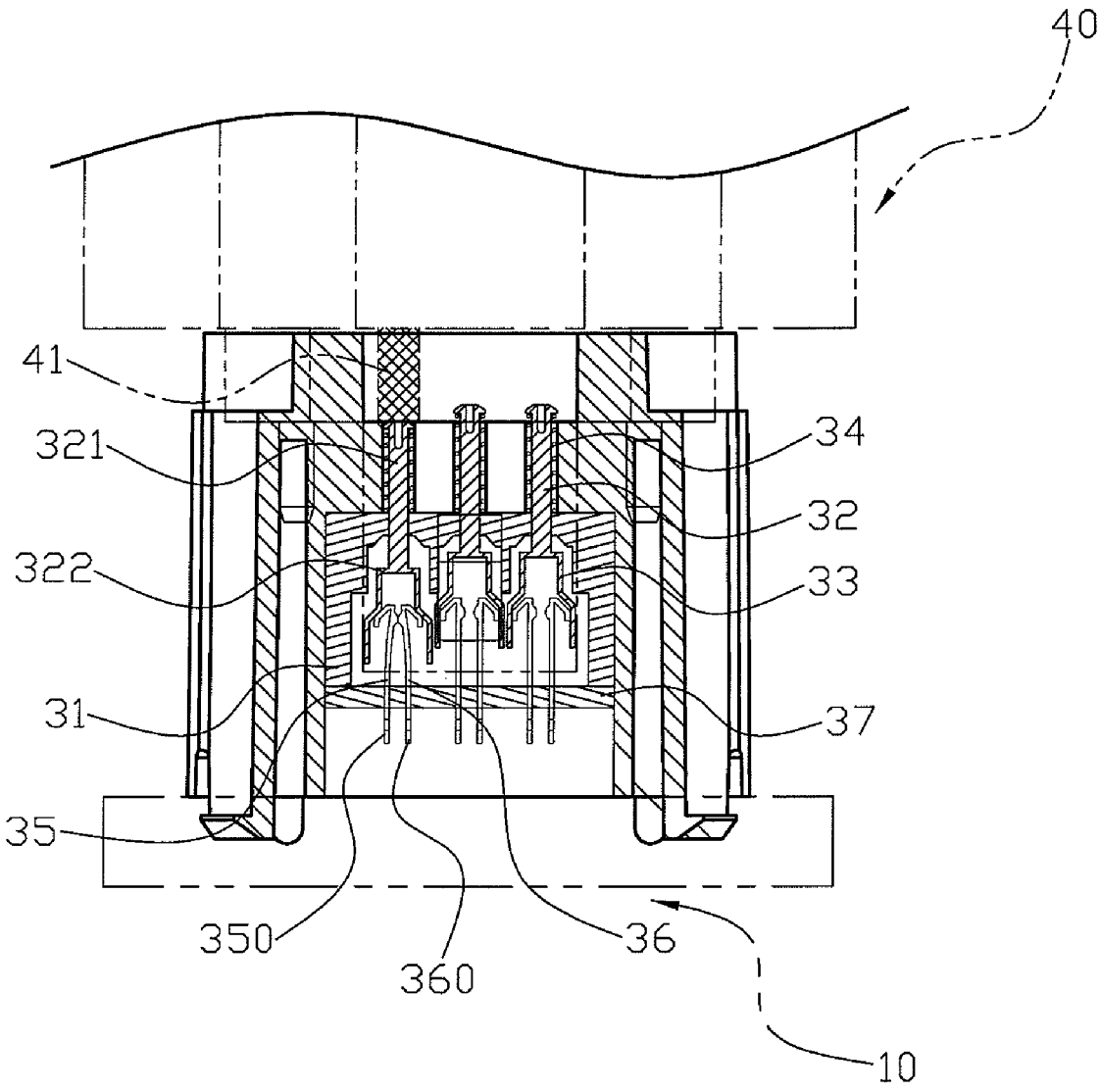
FIG. 10 is a front cross-sectional assembly view of the fluorescent lamp as shown in FIG. 9.

Referring to FIGS. 9 and 10, each of the elastic members 34 of the power regulating switch 30 is biased between the top of the housing 31 and a respective one of the push rods 32, each of the conducting bridges 33 of the power regulating switch 30 is an insulating member, and the first contacts 35 of the power regulating switch 30 are separated from each other. Thus, each of the conducting bridges 33 of the power regulating switch 30 is pressed downward by a respective one of the push rods 32 to press the respective first contact 35 and the respective second contact 36 to move toward and touch each other so as to conduct the respective first contact 35 with the respective second contact 36 and the respective inductors 38 and to form the circuit of the power regulating switch 30.

Accordingly, the circuit of the power regulating switch 30 has different values of inductance and different values of output power by provision of the inductors 38, and the output power of the power regulating switch 30 is adjusted and regulated by the location of the identification block 41 of the fluorescent tube 40 and by the electrical connection between each of the first contacts 35 and the respective different second contact 36 of the power regulating switch 30 so as to fit the fluorescent tube 40 of different power specifications, thereby enhancing the versatility of the ballast 10. In addition, the power regulating switch 30 has a simple mechanical design, thereby decreasing the costs of fabrication of the fluorescent lamp.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A fluorescent lamp, comprising:

a ballast;

a holder mounted on the ballast;

a power regulating switch mounted in the holder and connected with the ballast;

a fluorescent tube detachably mounted on the holder and contacting the control switch to actuate the control switch to regulate an output power of the ballast;

wherein the power regulating switch includes:

a housing secured in the holder;

a base received in the holder and combined with the housing;

plurality of inductors mounted in the base;

a plurality of first contacts each mounted in the base;

a plurality of second contacts each mounted in the base and each electrically connected with at least one of the inductors;

a plurality of conducting bridges each movable to touch and conduct a respective one of the first contacts and a respective one of the second contacts to form a circuit;

a plurality of push rods each movably mounted on the housing and each abutting a respective one of the conducting bridges to move the respective conducting bridge to conduct the respective first contact and the respective second contact;

a plurality of elastic members each biased on a respective one of the conducting bridges to push the respective conducting bridge to detach from the respective first contact and the respective second contact.

2. The fluorescent lamp of claim 1, wherein each of the elastic members of the power regulating switch is biased between the base and the respective conducting bridge.

3. The fluorescent lamp of claim 1, wherein the inductors of the power regulating switch are connected serially.

4. The fluorescent lamp of claim 1, wherein the holder has a first end provided with a slot to allow insertion of the fluorescent tube, a second end provided with a chamber to receive the control switch and a mediate portion provided with a plurality of channels connected between the slot and the chamber;

the housing of the power regulating switch has a top provided with a plurality of conduits;

each of the push rods of the power regulating switch is movably mounted in a respective one of the channels of the holder and a respective one of the conduits of the housing.

5. The fluorescent lamp of claim 4, wherein each of the push rods of the power regulating switch has an upper end protruding outwardly from the respective channel of the holder into the slot of the holder and a lower end provided with an enlarged pressing block abutting the respective conducting bridge.

6. The fluorescent lamp of claim 5, wherein the fluorescent tube has an end portion inserted into the slot of the holder and provided with a protruding identification block pressing the upper end of a respective one of the push rods to push the respective push rod and the respective conducting bridge to conduct the respective first contact and the respective second contact.

7. The fluorescent lamp of claim 1, wherein each of the elastic members of the power regulating switch is biased between a top of the housing and a respective one of the push rods.

8. The fluorescent lamp of claim 7, wherein each of the conducting bridges of the power regulating switch is an insulating member;

the first contacts of the power regulating switch are separated from each other;

the second contacts of the power regulating switch are separated from each other;

each of the conducting bridges of the power regulating switch is pressed downward by a respective one of the push rods to press the respective first contact and the respective second contact to move toward and touch each other so as to conduct the respective first contact with the respective second contact and the respective inductors and to form a circuit of the power regulating switch.

9. The fluorescent lamp of claim 4, wherein the chamber of the holder has a periphery provided with two opposite guide tracks;

the housing of the power regulating switch has a periphery provided with two opposite protruding guide rails mounted in the two opposite guide tracks of the holder respectively to guide insertion of the housing into the chamber of the holder;

the base of the power regulating switch has a periphery provided with two opposite protruding guide rails mounted in the two opposite guide tracks of the holder respectively to guide insertion of the base into the chamber of the holder.

10. The fluorescent lamp of claim 4, wherein the chamber of the holder has a side provided with a locking hole;

the housing of the power regulating switch has a side provided with a locking block snapped into and locked in the locking hole of the holder to fix the housing of the power regulating switch in the chamber of the holder.

11. The fluorescent lamp of claim 2, wherein the base of the power regulating switch has a periphery provided with a plurality of hollow posts to receive the elastic members respectively;

each of the elastic members of the power regulating switch is received in a respective one of the hollow posts of the base.

12. The fluorescent lamp of claim 1, wherein each of the conducting bridges of the power regulating switch has a substantially inverted U-shaped profile.

13. The fluorescent lamp of claim 1, wherein each of the conducting bridges of the power regulating switch is a conductor;

the first contacts of the power regulating switch are electrically connected with each other;

the first contacts of the power regulating switch are combined together to have a common lower leg protruding outwardly from a bottom of the base;

the second contacts of the power regulating switch are separated from each other;

each of the second contacts of the power regulating switch has a lower leg protruding outwardly from the bottom of the base.

14. The fluorescent lamp of claim 5, wherein the pressing block of each of the push rods is movable in the housing and is movable to abut the top of the housing to prevent each of the push rods being detached from the housing.

15. The fluorescent lamp of claim 6, wherein the slot of the holder has a periphery provided with two opposite enlarged passages;

the upper end of each of the push rods extends into one of the two passages of the holder;

the identification block of the fluorescent tube is inserted into one of the two passages of the holder.

16. The fluorescent lamp of claim 1, wherein each of the second contacts of the power regulating switch is electrically connected with the inductors of different numbers so that when each of the first contacts and the respective second contact of the power regulating switch are conducted, the circuit of the power regulating switch has different values of inductance.

17. The fluorescent lamp of claim 4, wherein the housing of the power regulating switch is received in the chamber of the holder;

the base of the power regulating switch is received in the chamber of the holder and is located under the housing.

18. The fluorescent lamp of claim 1, wherein each of the conducting bridges of the power regulating switch is movably mounted between the base and the housing.

19. The fluorescent lamp of claim 2, wherein each of the conducting bridges of the power regulating switch is located above the base and is located between the respective push rod and the respective elastic member.

20. The fluorescent lamp of claim 13, wherein the first contacts of the power regulating switch extend through the base;

each of the second contacts of the power regulating switch extends through the base.

* * * * *